United States Patent [19]

Omori

[11] 3,973,372

[45] Aug. 10, 1976

[54] METHOD FOR AUTOMATICALLY PACKING GOODS

[76] Inventor: Shozo Omori, No. 7-4, Negishi 5-chome, Taito-ku, Tokyo, Japan

[22] Filed: Oct. 23, 1974

[21] Appl. No.: 517,321

[30] Foreign Application Priority Data

| | | |
|---|---|---|
| Dec. 14, 1973 | Japan | 48-138678 |
| Dec. 14, 1973 | Japan | 48-138679 |
| Apr. 17, 1974 | Japan | 49-42310 |
| May 28, 1974 | Japan | 49-59895 |
| May 28, 1974 | Japan | 49-59896 |

[52] U.S. Cl. ..... 53/33; 53/182 R; 53/222; 53/381 R

[51] Int. Cl.[2] ..... B65B 11/22

[58] Field of Search ..... 53/28, 32, 33, 34, 180, 53/182, 222, 226, 381 R

[56] References Cited

UNITED STATES PATENTS

| | | | |
|---|---|---|---|
| 3,090,174 | 5/1963 | Kraft | 53/28 X |
| 3,303,630 | 2/1967 | Harm | 53/182 X |
| 3,473,288 | 10/1969 | Nakamura et al. | 53/182 X |
| 3,544,340 | 12/1970 | Miller et al. | 53/28 X |

*Primary Examiner*—Leon Gilden
*Attorney, Agent, or Firm*—Otto John Munz

[57] ABSTRACT

Method and apparatus for automatically packing goods which are fed continuously in series spaced a predetermined distance from each other by means of a continuously fed strip of a stretch film having self-adhering and resiliently stretchable natures. The strip is fed by conveyor clamping opposite sides edges of the strip along the direction of feeding of the goods from above the same obliquely downwardly to intersect the path of feeding of the goods so that the upper side and lateral sides of the respective goods are wrapped by the strip as the strip is being fed. After the upper and lateral sides of the respective goods are wrapped by the strip, the opposite longitudinal side edges are introduced into converging guide slots so that they are folded back upon the bottom side of the respective goods where they are joined adhered with each other to form a cylindrically shaped strip onto the bottom side of which the joined longitudinal edges are adhered. Then, the cylindrically shaped strip is severed at positions intermediate the portions in which the respective goods are wrapped to leave leading and trailing ear portions. The leading and trailing ear portions are folded back upon the bottom side of the severed cylindrically shaped strip section in which the goods is wrapped so as to be adhered thereto by ear portion capturing devices, respectively, which are moved relative to the feeding of the cylindrically shaped strip section.

3 Claims, 36 Drawing Figures

METHOD FOR AUTOMATICALLY PACKING GOODS

BACKGROUND OF THE INVENTION

The present invention relates to a method and an apparatus for automatically packing goods and, more particularly, to a method and an apparatus for automatically packing goods such as vegetables, cucumbers, tomatoes and egg-plants, for example, whether on not they are placed on a plastic tray; fruits, apples and grapes, for example, whether or not they are placed on a plastic tray; and fresh meat and the like whether or not it is placed on a plastic tray, which goods are fed continuously in a direction in series spaced a predetermined distance from each other on a conveyor, by means of a continuously fed strip of a stretch film having self-adhering and resiliently stretchable natures so as to form separate packs of goods wrapped by the strip section of the stretch film.

Recently, a method and an apparatus for wrapping vegetables, cucumbers, tomatoes and egg-plants, for example, fruits, apples and grapes, for example, and fresh meat and the like, which are placed on plastic trays, by means of a plastic film have been developed.

Heretofore used packing films are mainly of polycellophane polypropylene, nylon, vinylidene chloride and the like most of which are of gas impermeable nature, so that hermetically sealed packs are produced by these films.

Shrink packs have also been developed in which plastic films such as vinyl chloride polypropylene film of thermally shrinking nature is used and the film is shrunk by applying heated air thereto after the goods is loosely wrapped by the film so that the pack is made tight. In any case, a heat sealing process must be effected in order to bond the film after a goods is wrapped by the film in which process the portions of the film to be bonded are melted and pressure is applied to the molten portions of the film. Thus, it is rendered difficult to open the pack and, in case of shrink packs, the film is cured or hardened after it is shrunk by heat so that the overall surface of the film is made stiff thereby imparting to the pack a feeling which is unpleasant to customers.

Further, when such films having gas impermeable nature are used in wrapping vegetables, fruits and fresh meat and the like, the appearance of the packs is impaired by translucent vapor developed on the inner surface of the film generated by the goods wrapped therein.

Recently, a so-called stretch film having self-adhering and resiliently stretchable natures as well as a high permeability of carbon dioxide gas has been developed for wrapping vegetables, fruits, fresh meat and the like in order to avoid the above described disadvantages of the heretofore used films.

Packing machines utilizing the above described stretch film have also been developed. However, all of the packing machines using the stretch film heretofore proposed operate in such a manner that the film is first placed stationarily and the goods to be wrapped are pressed against the film from the lower side thereof so that the upper side and the lateral sides of the goods are wrapped by the film and then the goods are lifted together with the film so as to fold the edge portions of the film extending beyond the goods back upon the bottom side thereof so that the wrapping of the goods is completed by having the edge portions of the film adhere together on the bottom side of the goods. Thus, the operation is rendered very troublesome and is necessarily made intermittently, thereby lowering the efficiency.

When packing machines designed to use previously described polycellophane film, polypropylene film and the like are used together with the stretch film, unsightly creases and folds are generated in the film after wrapping the goods, and, since the stretch film is of the self-adhering nature, the generated creases adhere with each other so that the creases are permanently retained in the film. Thus, the packing machine for use with the polycellophane film and the polypropylene film can not be satisfactorily used with the stretch film.

SUMMARY OF THE INVENTION

The present invention avoids the above described disadvantages of the prior art method and apparatus for packing goods with the stretch film.

An object of the present invention is to provide a novel and useful method for automatically packing goods fed continuously on a conveyor in a direction spaced apart from each other by means of a continuously fed stretch film so as to form separate packs and a novel and useful apparatus for carrying out the above described method.

Another object is to provide a novel and useful method for automatically producing a cylindrically shaped strip section of the stretch film having a goods wrapped therein as well as leading and trailing ear portions extending from the portion of the strip section within which the goods is wrapped, so that a complete pack is formed by folding the ear portions back upon the bottom side of the cylindrically shaped strip section so as to be adhered thereto and a novel and useful apparatus for carrying out the above described method.

The above described objects are achieved in accordance with the characteristic feature of the present invention by providing a method of automatically packing goods fed continuously in a direction in series spaced a predetermined distance from each other to form separate packs by means of a continuously fed strip of a stretch film having self-adhering and resiliently stretchable natures, the method being characterized by the steps of feeding the strip along the direction of feeding of the goods from above the same obliquely downwardly so as to intersect the path of feeding of the goods with the strip held tensioned laterally of the direction of feeding thereof thereby wrapping the respective goods from the upper side over both lateral sides thereof, guiding continuously opposite longitudinal side edge portions of the strip after wrapping the upper and lateral sides of the respective goods toward around the bottom side thereof so as to form a cylindrical shape wrapping the same therein, pressing the opposite longitudinal side edge portions of the strip together after joined at the bottom side of the respective goods to secure the same together onto the bottom side of the cylindrically shaped strip wrapping therein the respective goods, and severing successively the thus cylindrically shaped strip laterally thereof intermediate the portions in which the respective goods are wrapped leaving leading and trailing ear portions of appropriate length, thereby permitting separate packs to be formed by folding the leading and trailing ear portions back upon the bottom side of the cylindrically shaped strip in which the respective goods is wrapped.

With the method described above, a cylindrically shaped strip section having a goods wrapped therein and having the leading and the trailing ear portion is fully automatically and continuously produced thereby permitting a complete pack to be formed by merely folding the leading and trailing ear portions back upon the bottom side of the cylindrically shaped strip section so as to be adhered thereto.

Similarly, in accordance with the present invention, an apparatus for carrying out the above described method is provided which is characterized by the pairs of endless chain or endless belt conveyor means with one pair located at each longitudinal side edge portion of the strip and cooperating with each other for continuously feeding the strip along the direction of feeding of the goods from above the same obliquely downwardly with the strip being tensioned laterally of the direction of feeding of the strip so that the strip contacts the upper side of the respective goods and wraps the upper and lateral sides thereof, means for guiding the opposite longitudinal side edge portions of the strip after the same wraps the upper and lateral sides of the respective goods so as to be folded back upon the bottom side of the respective goods and joined together to form a cylindrical shape within which the respective goods is wrapped, means for pressing the thus joined opposite longitudinal side edge portions together onto the bottom side of the thus formed cylindrical shaped of the strip, and means for severing laterally the thus cylindrically shaped strip intermediate the portions thereof in which the respective goods are wrapped leaving leading and trailing ear portions extending forwardly and rearwardly from each section of the cylindrically shaped strip wrapping therein the respective goods, thereby permitting separate packs to be formed by folding the leading and trailing ear portions back upon the bottom side of the cylindrically shaped strip section so as to be adhered thereto.

In accordance with a further characteristic feature of the present invention a method of automatically securing the trailing ear portion extending rearwardly from a cylindrically shaped, continuously fed strip section of the stretch film within which a goods is wrapped is provided which is characterized by the steps of supporting the cylindrically shaped strip section on a first conveyor means having at least a discontinued clearance in the stretch of the first conveyor means and driven at a predetermined speed but allowing the cylindrically shaped strip section supported thereon to be freely slid relative thereto, feeding the cylindrically shaped strip section by a second conveyor means at a speed lower than that of the first conveyor means, capturing the trailing ear portion by suction force into the discontinued clearance in the first conveyor means when the trailing ear portion is aligned with the clearance, thereby permitting the trailing ear portion to be folded back upon the bottom side of the cylindrically shaped strip section by virtue of the trailing ear portion being captured in the clearance in the first conveyor means moved at the speed higher than that of the second conveyor means by which the cylindrically shaped strip section is fed.

Similarly, in accordance with the present invention, an apparatus for carrying out the above described method is provided which is characterized by a first conveyor means having at least a discontinued clearance in the stretch of the first conveyor means and driven at a predetermined speed but allowing the cylindrically shaped strip section supported thereon to be freely slid relative thereto, a second conveyor means driven at a speed lower than that of the first conveyor means on the first conveyor means for feeding the cylindrically shaped strip section at the lower speed, vacuum means arranged beneath the stretch of the first conveyor means supporting the cylindrically shaped strip section for sucking and capturing the trailing ear portion when the same is brought above the vacuum means while, at the same time, the discontinued clearance is moved in alignment with the vacuum means during the movement of the first conveyor means, thereby permitting the trailing ear portion to be folded back upon the bottom side of the cylindrically shaped strip section so as to be adhered thereto by virtue of the clearance capturing the trailing ear portion therein being moved at the speed higher than that of the second conveyor means by which the cylindrically shaped strip section is fed.

In accordance with the present invention, capturing of the trailing ear portion may be effected by a mechanical swingable capturing means provided in the first conveyor means in place of suction force so as to more positively capturing the trailing ear portion as described later.

In accordance with a still further feature of the present invention, a method of automatically securing the leading ear portion extending forwardly from the cylindrically shaped, continuously fed strip section is provided which is characterized by the steps of feeding the cylindrically shaped strip section by a conveyor means with the underside of the cylindrically shaped strip section being held cleared to provide a space and applying suction force at the space from beneath the leading ear portion so as to releasably capture the leading ear portion, and feeding the cylindrically shaped strip section onto guide means by the conveyor means, thereby permitting the leading ear portion to be folded back upon the bottom side of the cylindrically shaped strip section so as to be adhered thereto by virtue of the releasably captured leading ear portion being pressed against the bottom side of the cylindrically shaped strip section by the guide means as the cylindrically shaped strip section is fed by the conveyor means on said guide means.

Similarly, an apparatus for carrying out the above described method is provided which is characterized by conveyor means for feeding the cylindrical shaped strip section with the under side thereof being held cleared to provide a space beneath the path of the cylindrically shaped strip section, vacuum means arranged in the space for sucking and releasably capturing the leading ear portion, guide means arranged downstream of the vacuum means for slidingly supporting the cylindrically shaped strip section thereby permitting the leading ear portion to be folded back upon the bottom side of the cylindrically shaped strip section so as to be adhered thereto by virtue of the cylindrically shaped strip section being fed on the guide means by the conveyor means while the leading ear portion is releasably captured by the vacuum means.

In accordance with the present invention, the capturing of the leading ear portion may be effected by a vertically swingable conveyor means cooperating with conveyor means stationarily arranged downstream of the swingable conveyor means but allowing the cylindrically shaped strip section supported thereon to be freely slid relative thereto in place of vacuum means so as to more positively capture the leading ear portion without fail as described later.

DETAILED DESCRIPTION OF THE PREFERRED EMBODIMENTS

Figure 1:
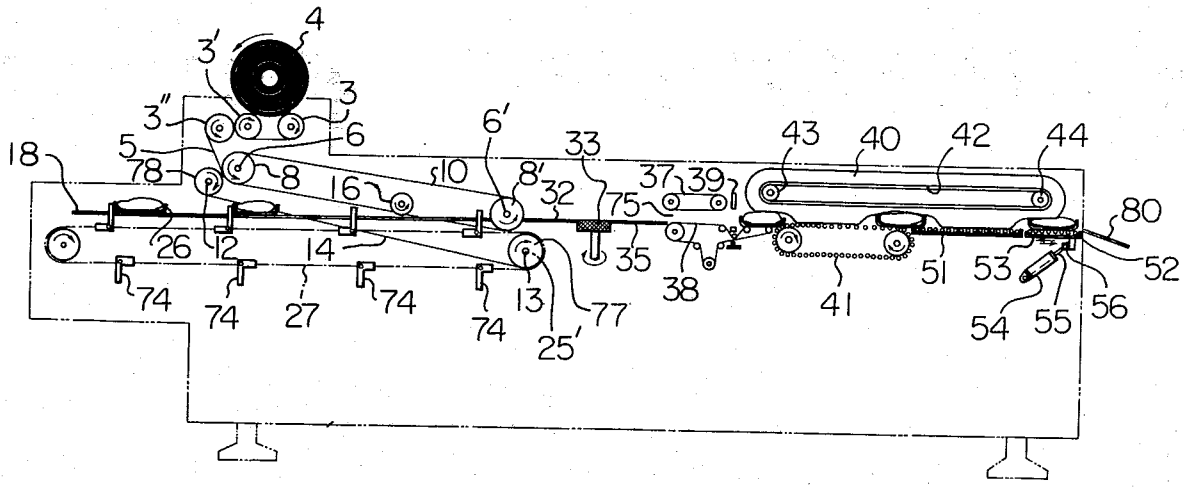
FIG. 1 is a general side view schematically showing the entire construction of the first embodiment of the present invention.
Figure 2:
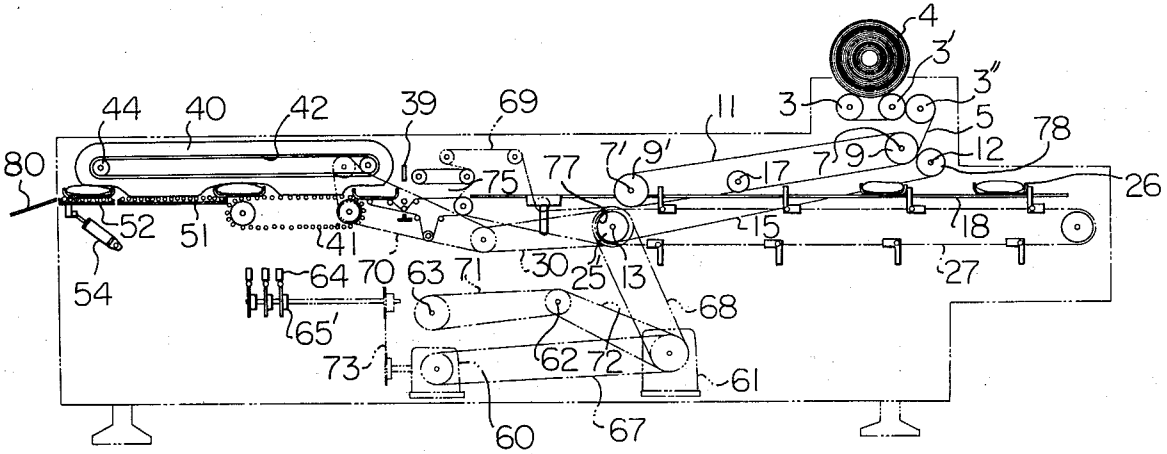
FIG. 2 is a general side view similar to FIG. 1 but illustrating the opposite side of the apparatus.
Figure 3:
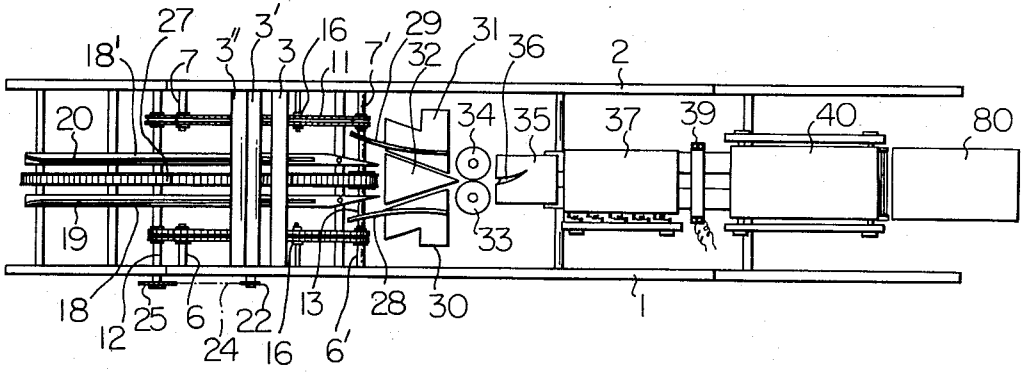
FIG. 3 is a general plan view of FIG. 1.

Referring now FIGS. 1 to 3 showing the first embodiment of the present invention, three parallel rolls 3, 3′ and 3″ are rotatably mounted on frames 1, 2 and a roll 4 of the strip 5 of the stretch film is supplied on the rolls 3 and 3′ so that the roll 4 is rotated in the direction shown by the arrow and the strip 5 is unwound from the roll 4 around the roll 3, the roll 3′ and the roll 3″ as shown. In order to unwind the strip 5, the outer end of the shaft of the roll 3′ is provided with a sprocket 22 and an endless chain 24 is stretched around the sprocket 22 and a sprocket 25 secured to the outer end of a shaft 12 rotatably supported by the frames 1, 2 and fixedly mounting thereon a pair of sprockets 78, 78 which are driven by a pair of double link chains 14, 15 each stretched around the respective sprockets 78, 78 as described later so that the roll 3′ is rotated through the sprockets 25, 22 for unwinding the roll 4.

Figure 7:
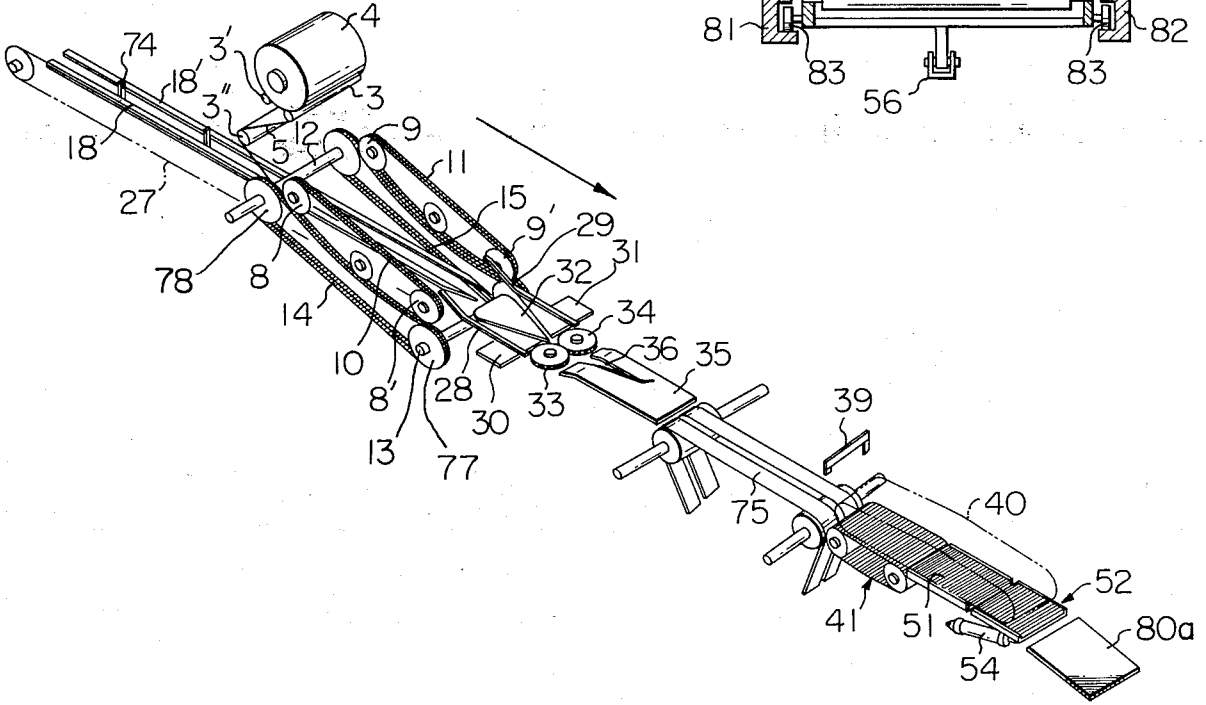
FIG. 7 is a general perspective view showing the apparatus of FIG. 1 with some parts omitted for clear showing.

A chain conveyor 27 provided with feeding claws 74 arranged a predetermined distance spaced from each other is located horizontally beneath the sprockets 78, 78 longitudinally along the center line of the frames 1, 2 and a pair of lower guide plates 18, 18′ and a pair of side guide plates 19, 20 are arranged in parallel to the chain conveyor 27 at opposite sides thereof in symmetry to each other as shown in FIGS. 3 and 7 so that each respective tray 26 supporting thereon the goods to be wrapped is transported by a respective feeding claw 74 of the chain conveyor 27 from the left to the right in FIG. 1 while each tray 26 is guided by the lower and side guide plates 18, 18′, 19, 20 as shown in FIG. 1.

A shaft 13 is rotatably supported by the frames 1, 2 beneath the guide plates 18, 18′ downstream of the feeding of the trays 26 as shown in FIGS. 1 and 7. The shaft 13 fixedly mounts thereon a pair of sprockets 77, 77 and a pair of endless double link chains 14, 15 are stretched around the sprockets 78, 78 of the shaft 12 and the sprockets 77, 77 of the shaft 13, respectively. As shown upon FIG. 2, the shaft 13 also fixedly mounts thereon a sprocket, and an endless chain 68 is stretched around the sprocket of the shaft 13 and a sprocket of a reduction gear 61 driven by a motor 60 through a chain 67 so that the sprockets 77, 77 are rotated for driving the double link chains 14, 15 thereby rotating the sprockets 78, 78 so as to drive the roll 3′ through the chain 24 as previously described.

As shown in FIG. 2, the sprocket 25′ for driving the chain conveyor 27 is fixedly mounted on the shaft 13 so that the chain conveyor 27 is operated by the rotation of the shaft 13.

As shown in FIGS. 1 to 3, a pair of stub shafts 6, 7 are fixedly mounted on the frames 1, 2, respectively, adjacent to the shaft 12 slightly above and downstream of the feeding of the trays 26 and rotatably mount thereon sprockets 8 and 9, respectively, in alignment with the sprockets 78, 78 of the shaft 12, respectively. In like manner, a pair of stub shafts 6′, 7′ are fixedly mounted on the frames 1, 2 sightly above and upstream of the feeding of the trays 26, respectively, and the rotatably mount thereon sprockets 8′, 9′ in alignment with the sprockets 77, 77 of the shaft 13, respectively.

An endless double link chain 10 is stretched around the sprocket 8 and the sprocket 8′ with the lower stretch of the double link chain 10 being urged downwardly by a tension sprocket 16 adjustably mounted on the frame 1 so that the lower stretch of the double link chain 10 tightly contacts with the upper stretch of the double link chain 14. In like manner, an endless double link chain 11 is stretched around the sprockets 9 and 9' with the lower stretch of double link chain 11 being urged downwardly by a tension sprocket 17 adjustably mounted on the frame 2 so that the lower stretch of the double link chain 11 tightly contacts with the upper stretch of the double link chain 15.

In accordance with the present invention, the opposite longitudinal side edge of the strip 5 fed from the roll 3' are clamped between the double link chains 10, 14 and the double link chains 11, 15, respectively, so that the strip 5 is fed along the feeding of the trays 26 from above the same obliquely downwardly so as to intersect the path of feeding of the trays 26 while the strip 5 is tensioned laterally of the direction of feeding thereof by the double link chains 10, 14 and the double link chains 11, 15.

The speed of feeding of the strip 5 by the double link chains 10, 15 and 11, 15 is controlled so as to be equal to that of feeding of the trays 26 by the chain conveyor 27.

As described above, since the strip 5 is fed obliquely downwardly from above the path of feeding of the trays 26 to intersect the same, the strip 5 is first contacted with the upper side of the goods placed on the tray 26 fed foremost of the series of trays 26 on the chain conveyor 27 and wraps the upper side and lateral sides of the goods and the tray 26 as the strip 5 is continuously fed while the tray 26 is continuously fed on the chain conveyor 27.

A pair of supporting members 30, 31 supporting guide plates 28, 29, respectively, are located downstream of the chain conveyor 27 with the upper stretch thereof being aligned with the upper sides of the supporting members 30, 31 as shown in FIG. 3. A triangle-shaped guide member 32 is interposed between the members 30, 31 with its upper surface flush with the upper sides of the members 30, 31 and with the apex of the member 32 being directed downstream of feeding of the tray 26 so that a pair of guide slots converging toward downstream of the feeding of the tray 26 are formed between supporting members 30, 31 and the guide plate 32 as shown in FIG. 3.

The opposite longitudinal side edge portions of the strip 5 after it has wrapped the upper side and lateral sides of the goods and tray 26 supporting the same are inserted into the guide slots, respectively, and guided therethrough so that the opposite longitudinal side edge portions of the strip 5 are bent around toward the bottom side of the tray 26 supported on the guide member 32 so as to be joined together thereby forming a cylindrically shaped strip in which the goods and the tray 26 are wrapped. A pair of pressing rollers 33, 34 rotating about the vertical axes in opposite directions in contact with each other are located downstream of the guide member 32 with the nip of the rollers 33, 34 being in alignment with the apex of the member 32 and the upper surfaces of the rollers 33, 34 being flush with the upper side of the member 32. The rollers 33, 34 are preferably knurled. The joined opposite longitudinal side edge portion of the strip 5 after it has been thus formed in the cylindrically shaped strip wrapping therein thhe goods and the tray are introduced into the nip of the rollers 33 and 34 so that they are positively adhered with each other by the self-adhering nature of the strip 5. Thus, the rollers 33, 34 serve also to advance the cylindrically shaped strip.

A guide plate 35 having a curved guide slot 36 is located downstream of the rollers 33, 34 with the upper surface of the plate 35 being flush with the upper sides of the rollers 33, 34. The open inlet end of the slot 36 is located in alignment with the nip of the rollers 33 and 34 and the slot 36 is curved so as to be deflected apart from the path of feeding of the goods and the tray 26 toward the downstream side and terminates in the guide plate 35 as shown in FIGS. 3 and 7. The adhered opposite longitudinal side edge portions of the cylindrically shaped strip after leaving the rollers 33, 34 are introduced into the slot 36 and bent toward one side of the bottom side of the cylindrically shaped strip so as to be adhered thereto during the time it is fed on the plate 35.

A transporting device 75 comprised of an upper endless belt 37 and a lower endless belt 38 is located downstream of the guide plate 35 as shown in FIG. 1. The upper endless belt 37 is driven by a chain 69 (FIG. 2) which is in turn driven by the shaft 13 rotated by the motor 60 as described previously. The transporting device 75 serves to advance the cylindrically shaped strip in which the goods and the tray 26 are wrapped.

A film cutting device 39 which may be of the impulse melting and cutting type or of any other suitable type is provided downstream of the transporting device 75. The film cutting device 39 is so operated by a crank 63 (FIG. 2) driven through chains 71, 72 by the motor 60 that it is moved in the direction of feeding of the cylindrically shaped strip in synchronism with the movement thereof when cutting of the cylindrically shaped strip is effected and moved again in the initial position after cutting has been effected.

The cutting device 39 is operated in timed relationship with the feeding of the cylindrically shaped strip. Therefore, by the cutting device 39, the cylindrically shaped strip is cut at positions intermediate of the portions of the cylindrically shaped strip in which portions the goods and the trays 26 are wrapped, so that leading ear portion 59 and trailing ear portion 58 (FIG. 4) are formed in each of the severed cylindrically shaped strip sections wrapping therein the goods and the tray 26.

In accordance with the feature of the present invention, apparatus for securing the leading ear portion 59 and the trailing ear portion 58 to the bottom side of the respective severed cylindrically shaped strip section is provided downstream of the cutting device 39.

The apparatus for securing the ear portion comprises an endless sponge-like belt conveyor 40 secured around an endless belt 42 provided with a toothed inner surface and stretched around sprockets 43 and 44 and located above the path of feeding of the cylindrically shaped strip section, an endless roller conveyor 41 having at least one discontinued clearance 76 and ear portion push member 46 at the trailing end of the clearance 76 and located beneath the path of feeding of the cylindrically shaped strip section for supporting the same, a stationarily arranged roller conveyor having a plurality of rotatable rollers 51 supported at both ends by side plates (not shown) and located in alignment with the upper stretch of the roller conveyor 41 downstream thereof for slidingly supporting the cylindrically shaped strip section, and a forwardly and rearwardly reciprocatable roller conveyor 52 (FIG. 5*a*), reciprocally driven by a piston rod 55 of a swingably supported cylinder 54.

The sprocket 43 driving the toothed belt 42 and one of the sprockets driving the roller conveyor 41 are driven by a chain 70 (FIG. 2) which is in turn driven by a chain 30 operated by a sprocket secured to the shaft 13 which is rotated by the motor 60 as described above, so that the sponge-like belt 40 and the roller conveyor 41 are driven.

In accordance with the present invention, a vacuum sucking member 47 (FIG. 4*a*), connected to a vacuum source (not shown) through a conduit 65 is located at a suitable position beneath the upper stretch of the roller conveyor 41, and a pressing device 48 comprising a pressing member 48' slidably supported by a bracket 50 and resiliently urged upwardly by a spring 49 is located downstream of the vacuum sucking member 47.

The roller conveyor 41 is provided with a plurality of freely rotatable rollers 45 so as to freely movably support the cylindrically shaped strip section wrapping therein the goods and the tray 26 and the roller conveyor 41 per se is driven at a higher speed than that of the sponge-like belt 40.

FIGS. 4*a* to 4*f* show the sequence of the operation for securing the trailing ear portion 58 to the bottom side of the cylindrically shaped strip section.

The cylindrically shaped strip section, after leaving the transporting device 75, is introduced between the lower stretch of the belt 40 and the upper stretch of the roller conveyor 41 and is fed by the belt 40 at the speed set by the belt 40, because the roller conveyor 41 allows the cylindrically shaped strip section supported thereon to be freely slid by virtue of freely rotatable rollers 45.

When the driving of the roller conveyor 41 is so timingly related with respect to the feeding of the cylindrically shaped strip section fed by the sponge-like belt 40 that the clearance 76 of the roller conveyor 41 comes into alignment with the vacuum sucking member 47 when the trailing ear portion 58 is fed above the vacuum sucking member 47. At the time the trailing ear portion 58, the clearance 76 and the vacuum sucking member 47 come into alignment with each other, the vacuum sucking member 47 is operated so that the trailing ear portion 58 is captured in the clearance 76 (FIG. 4*a*), and the trailing ear portion 58 is caught by the ear portion push member 46 since the member 46 is moved at the higher speed than that of the cylindrically shaped strip section advanced by the belt 40 (FIGS. 4*b*, 4*c*), and the vacuum sucking member 47 is rendered to be inoperable.

Figure 4A:
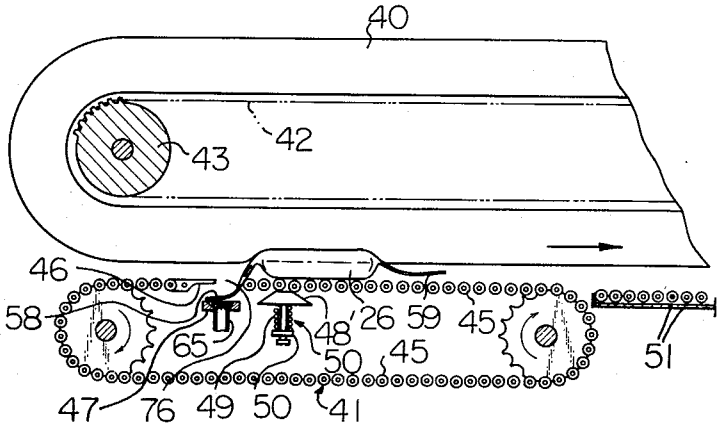
FIG. 4*a* to 4*f* are fragmentary side views showing the sequence of operation of apparatus for securing the trailing ear portion to the bottom side of the cylindrically shaped strip section wrapping therein a goods constructed in accordance with the present invention.
Figure 4B:
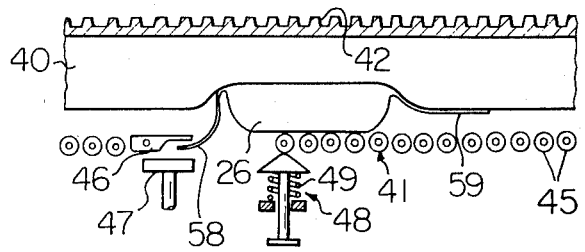
Figure 4C:
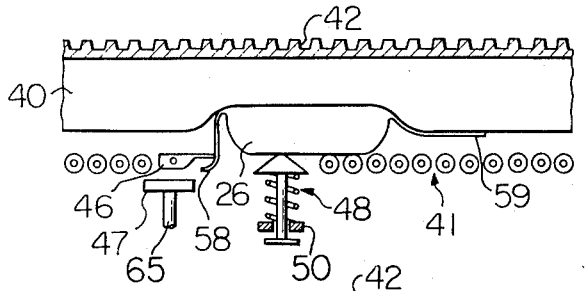
Figure 4D:
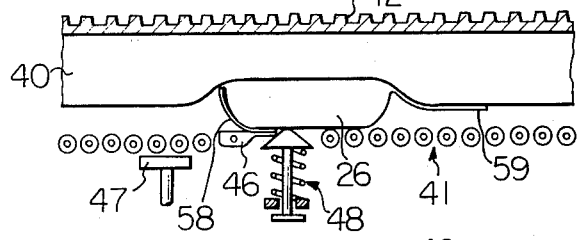
Figure 4E:
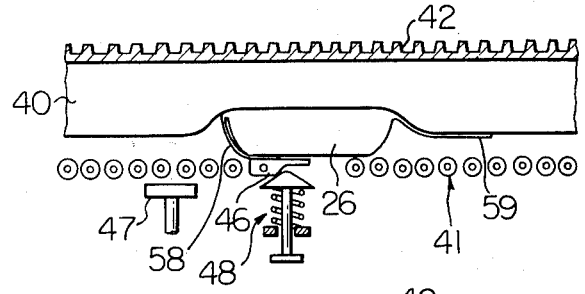
Figure 4F:
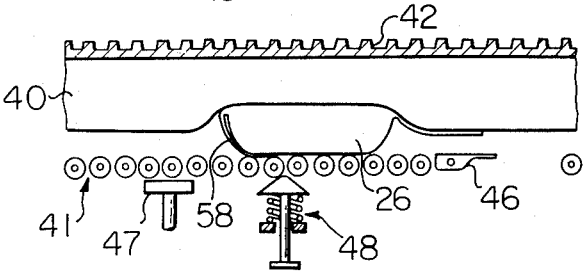

Thus, the trailing ear portion 58 is folded back upon the bottom side of the cylindrically shaped strip section by means of the push member 46 and urged thereagainst by the pressing device 48 as the cylindrically shaped strip section advances (FIGS. 4*d*, 4*e*) so that the trailing ear portion 58 is adhered to the bottom side of the cylindrically shaped strip section (FIG. 4*f*).

Turning now to FIGS. 5*a* to 5*d*, these figures show the sequence of operation for securing the leading ear portion 59 to the bottom side of the cylindrically shaped strip section.

A second vacuum sucking member 57 connected to a vacuum source (not shown) through a conduit 66 is located adjacent to and beneath the downstream end of the stationary roller conveyor comprised of the rotatable rollers 51 as shown.

Figure 6:
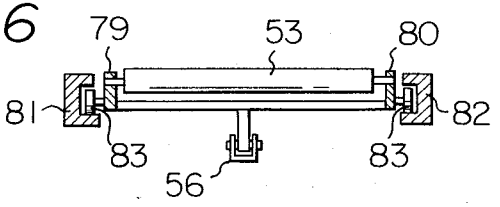
FIG. 6 is a cross-sectional view showing the reciprocal conveyor shown in FIGS. 5*a* to 5*d;*

The reciprocable roller conveyor 52 comprises a plurality of rotatable rollers 53 with their shafts supported by side plates 79, 80 which are in turn horizontally slidably supported in guide frames 81, 82 by means of rollers 83 mounted on the side plates 79, 80 and guided in grooves in the guide frames 81, 82 as shown in FIG. 6. A bracket 56 is provided on a cross bar connecting the side plates 79, 80 and the bracket 56 is connected to the outer end of the piston rod 55 of the cylinder 54 which is pivoted to the frames 1, 2 at the bottom side and energized by a source (not shown) so that the side plates 79, 80 (FIG. 6), are reciprocated together with the rollers 53 by the operation of the cylinder 54 so as to move the rollers 53 away from and toward the stationary roller conveyor comprised of rollers 51.

Figure 5A:
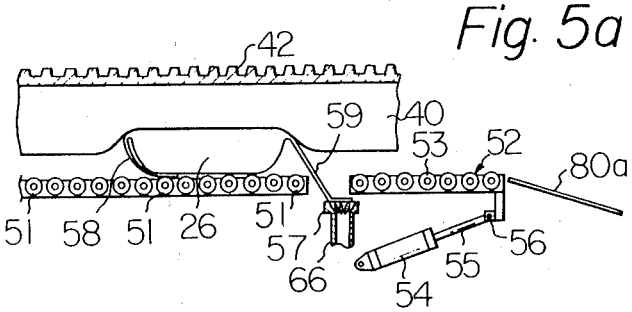
FIGS. 5*a* to 5*d* are fragmentary side views showing the sequence of operation of the apparatus for securing the leading ear portion to the bottom side of the cylindrically shaped strip section.

The operation of the cylinder 54 and the vacuum sucking member 57 is so timingly related to the feeding of the cylindrically shaped strip section supported on the rollers 51 that, when the leading ear portion 59 reaches the position above the vacuum sucking member 57, the cylinder 54 is actuated so that the reciprocal roller conveyor 52 is moved apart from the rollers 51 to clear a space above the vacuum sucking member 57 and, at the same time, the vacuum sucking member 57 is operated so as to capture the leading ear portion 59 in the space formed between the rollers 51 and the reciprocal roller conveyor 52 (FIG. 5*a*). After the leading ear portion 59 is captured in the space, the reciprocal roller conveyor 52 is moved toward the rollers 51 by the operation of the cylinder 54 so as slidably clamp the leading ear portion 59 between the roller 51 and the roller conveyor 52 (FIG. 5*b*), and, at the same time, the vacuum sucking member 57 is rendered to be inoperative.

Figure 5B:
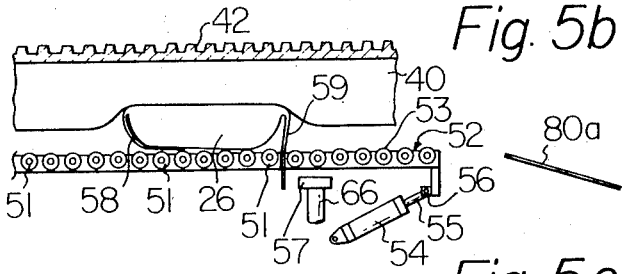
Figure 5C:
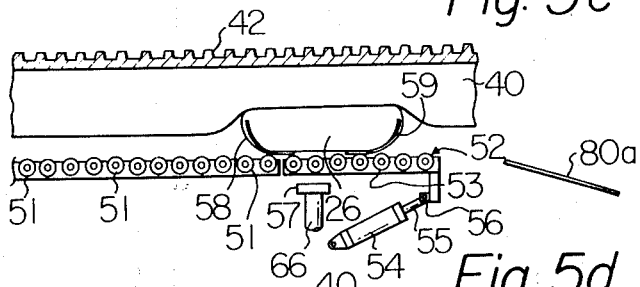
Figure 5D:
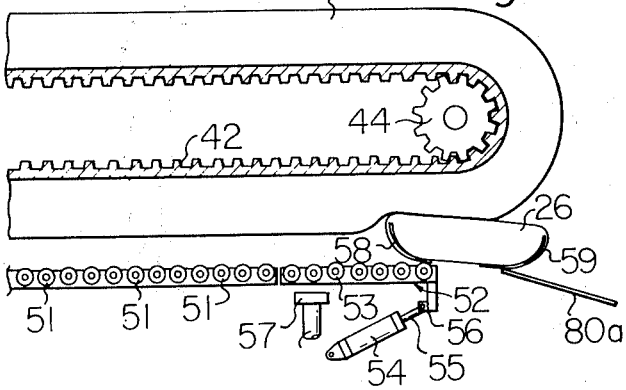

As the cylindrically shaped strip section is advanced by the sponge-like belt 40 from the position shown in FIG. 5*b*, the leading ear portion 59 is folded back upon the bottom side of the cylindrically shaped strip section so as to be adhered thereto (FIG. 5*c*), and then discharged from the apparatus onto a discharge chute **80*a*** (FIG. 5*d*).

Microswtiches 64 actauted by timing cams 65' which are driven by the motor 60 through a chain 73 (FIG. 2) serve to operate the apparatus in timed sequence as described above.

Thus, the complete pack wrapped by the strip section of the stretch film is automatically produced successively by the present invention without stopping the feeding of the goods and the trays 26 and the feeding of the strip 5 thereby incurring high efficiency of the operation of the apparatus of the present invention.

In the above description, the goods is shown as being placed on a tray 26, but it is apparent that the goods can be wrapped by the strip without using a tray 26.

Figure 8:
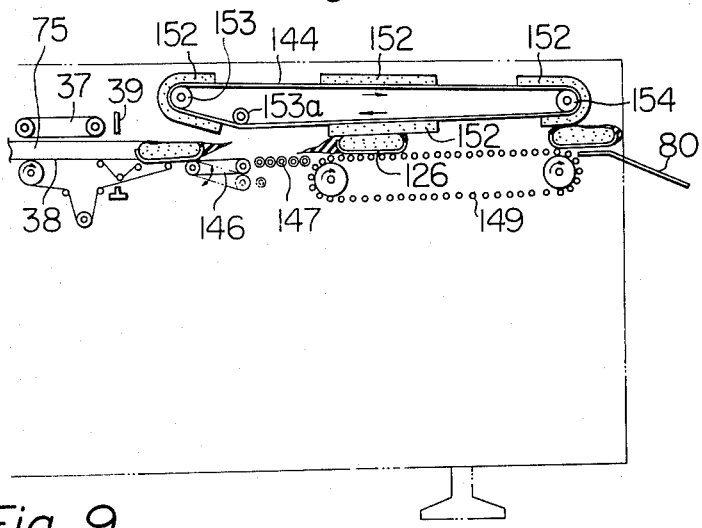
FIG. 8 is a fragmentary side view showing a modification of the apparatus for securing the leading and trailing ear portions to the bottom side of the cylindrically shaped strip sections shown in FIG. 1.

FIG. 8 shows an alternative form of the present invention for securing the leading and trailing ear portions of the cylindrically shaped strip section within which the goods is wrapped without using vacuum suction force but using mechanical means.

Figure 9:
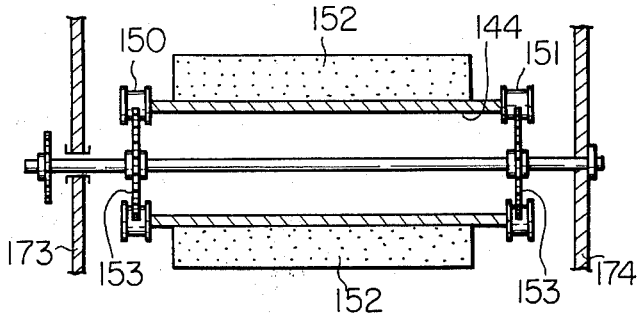
FIG. 9 is a cross-sectional view showing the arrangement of the endless conveyor for feeding the cylindrically shaped strip section shown in FIG. 8.

The apparatus shown is similar to that shown in FIG. 1 except that the sponge-like belt 40 in FIG. 1 is replaced by an endless belt 144 having a plurality of sponge-like members 152 secured a predetermined distance spaced from each other on the outer surface thereof and driven by chains 150, 151 secured to the opposite longitudinal side edges of the belt 144, respectively, which are engaged and driven by sprockets 153, 153 and 154, 154 as shown in FIGS. 8 and 9 and a vertically swingable belt conveyor 146 is provided for securing the leading ear portion 59 to the bottom side of the cylindrically shaped strip section in cooperation with a roller conveyor comprising a plurality of rotatable rollers 147 and the roller conveyor 41 of FIG. 1 is replaced by a roller conveyor 149 having at least one swingable ear portion capturing device 157 swingably mounted in the stretch of the conveyor 149 thereby dispensing with vacuum sucking members 47, 57 of FIGS. 4 and 5 for capturing the respective ear portion.

FIGS. 10*a* to 10*d* show the sequence of operation of securing the leading ear portion 59 to the bottom side of the cylindrically shaped strip section.

Tension sprockets 153*a* are provided so as to guide the lower stretch of the belt 144 along the path of feeding of the cylindrically shaped strip section thereby permitting the same to be fed by the respective sponge-like member 152 abutting against the upper side of the cylindrically shaped strip section.

The vertically swingable belt conveyor 146 comprises a pair of pulleys around which an endless belt is stretched so as to feed the cylindrically shaped strip section supported thereon. The conveyor 146 is provided with a lever 146*a* extending from the shaft stationarily positioned and supporting one of the pulleys and biased downwardly by a spring 146*b* so that the entire belt conveyor 146 is urged to swing in the clockwise direction about the shaft supporting the lever 146*a*. An eccentric cam 146*d* rotated about a shaft 146*c* operatively contacts with a roller mounted on the free end of the lever 146*a* so that the entire belt conveyor 146 is swung by the operation of the cam 146*d* between a first position in which the upper stretch is in alignment with the upper surface of the roller conveyor 145 and a second position inclined downwardly from the first position. The belt conveyor 146 further includes a rotatable roller 145 mounted at the free end of the conveyor 146 so that the roller 145 is brought in alignment with the roller 147 when the conveyor 146 is in the first position.

Now describing the operation for securing the leading ear portion 59 to the bottom side of the cylindrically shaped strip section with reference to FIGS. 10*a* to 10*d*.

Figure 10A:
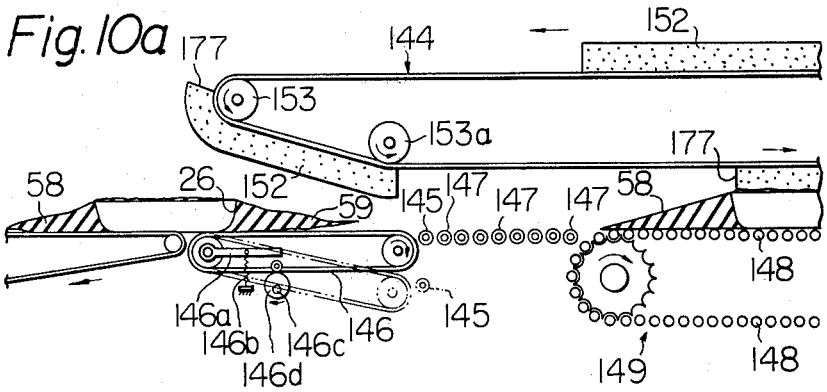
FIG. 10*a* to 10*d* are fragmentary side views showing the sequence of operation of the apparatus for securing the leading ear portion to the bottom side of the cylindrically shaped strip section shown in FIG. 8.
Figure 10B:
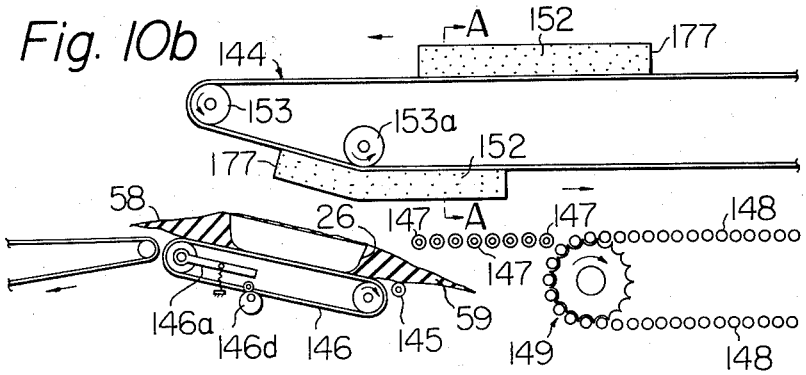
Figure 10C:
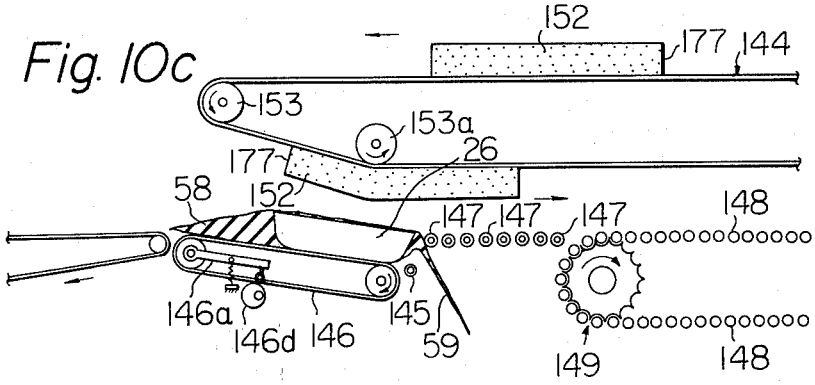
Figure 10D:
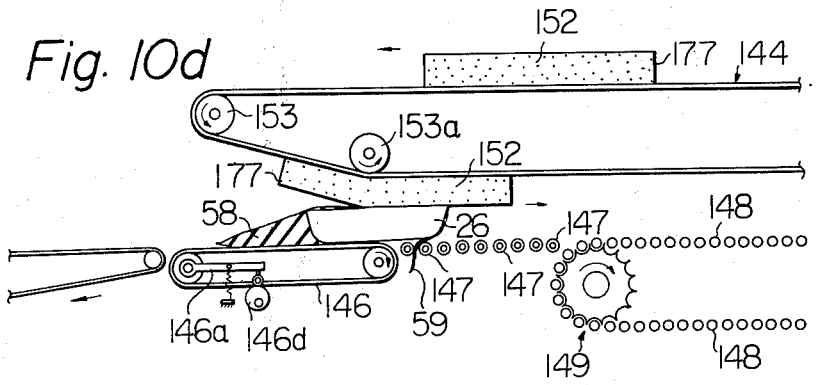

As the cylindrically shaped strip section with its leading ear portion 59 extending forwardly is brought onto the swingable belt conveyor 146 as shown in FIG. 10*a*, the belt conveyor 146 is swung by the action of the cam 146*d* from the first position shown in full line in FIG. 10*a* to the second position shown in two dot chain line in FIG. 10*a*. Thus, the leading ear portion 59 extends beyond the belt conveyor 146 and the roller 145 as the cylindrically shaped strip section is fed on the conveyor 146 as shown in FIG. 10*b*. At this time, the belt conveyor 146 is swung upwardly by the action of the eccentric cam 146*d* to the first position through the position shown in FIG. 10*c*. Therefore, the leading ear portion 59 is captured between the roller 145 and the roller 147 as shown in FIG. 10*d*. In this position, the cylidrically shaped strip section abuts against the sponge-like member 152 of the belt 144 so that the cylindrically shaped strip section is advanced on the roller conveyor comprised of rollers 147 with the leading ear portion 59 being slidably clampled between the roller 145 and the roller 147. Thus, the leading ear portion 59 is folded back upon the bottom side of the cylindrically shaped strip section so as to be adhered thereto.

The operation of the swingable belt conveyor 146 is timingly related with the feeding of the cylindrically shaped strip section by means not shown.

As is clear from the above description the leading ear portion 59 is positively captured mechanically without using vacuum sucking force, thereby insuring positive operation for securing the leading ear portion 59.

Now the apparatus for securing the trailing ear portion 58 mechanically without using vacuum sucking action will be described with reference to FIGS. 11 to 13.

Figure 11:
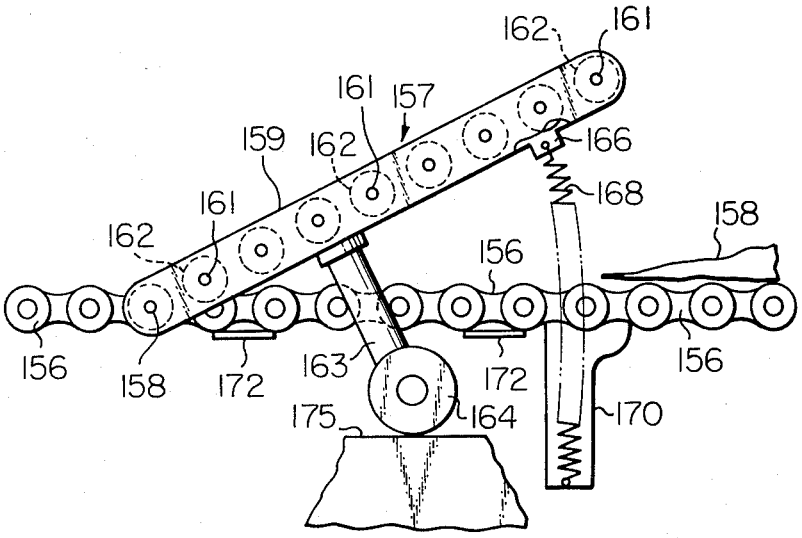
FIG. 11 is a fragmentary side view as seen toward the left from the right hand side swingable lever in FIG. 12 showing the construction of the swingable capturing means provided in the endless chain conveyors for supporting the cylindrically shaped strip section for releasably capturing the trailing ear portion.
Figure 12:
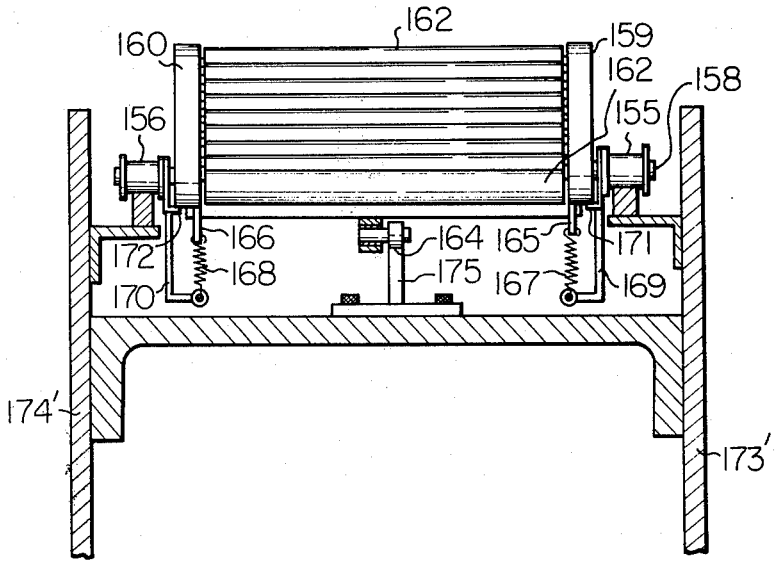
FIG. 12 is a front view of FIG. 11 as seen from the left in FIG. 11.

FIGS. 11 and 12 show a mechanical trailing ear portion capturing device 157 provided in the endless roller conveyor 149 comprised of a plurality of freely rotatable rollers 148.

The opposite ends of each of the rollers 148 are supported by link chains 155, 156 driven by two sets of sprockets around which the link chains 155, 156 are stretched. The upper stretch each of the link chains 155, 156 is guided by elongated guide plates secured to side plates 173', 174' of the frames 1, 2 respectively.

The capturing device 157 comprises a pair of levers 159, 160 pivoted at their one ends to the link chains 155, 156 by pins 158 of the link chains 155, 156. A plurality of rotatable rollers 162 are rotatably supported by pins 161 between the levers 159, 160 and the roller-lever assembly is adapted to be swung in alignment with and out upwardly of the cleared portion in the stretch of the roller conveyor 149 where the rollers 148 are not provided. In order to prevent the roller-lever assembly from being swung downwardly from the position in alignment with the the stretch of the roller conveyor 149, stopper plates 171, 172 are provided on the link chains 155, 156, respectively.

Supporting plates 169, 170 having bent tips are also provided on the link chains 155, 156, respectively, extending downwardly, and one ends of springs 167, 168 are secured to the bent tips of the supporting plates 169, 170, respectively, while the other ends are secured to projections 166 formed on the levers 159, 160 adjacent to the free ends thereof, respectively, so that the roller-lever assembly is urged by the springs 167, 168 downwardly.

A bracket 163 having a rotatable roller 164 mounted at its lower end is secured at its upper end to a cross bar connecting the levers 159, 160 (FIG. 12).

The roller 164 is adapted to rollingly engaging with a cam 175 stationarily secured to supporting member secured to the side plates 173', 174' (FIG. 12). Thus, the capturing device 157 is swung upwardly from the position in alignment with the stretch of the roller conveyor 149 against the action of the springs 167, 168 and swung downwardly in alignment with the stretch of the roller conveyor 149 by the action of the springs 167, 168 by the cam 175 engaging with the roller 164 as the roller conveyor 149 is running.

The roller conveyor 149 is driven at a higher speed than that of the belt 144 by which the respective cylindrically shaped strip section is fed, but it allows the cylindrically shaped strip section supported thereon to be freely slid relative thereto by virtue of the freely rotatable rollers 148 of the roller conveyor 149 in like manner as described previously.

Figure 13A:
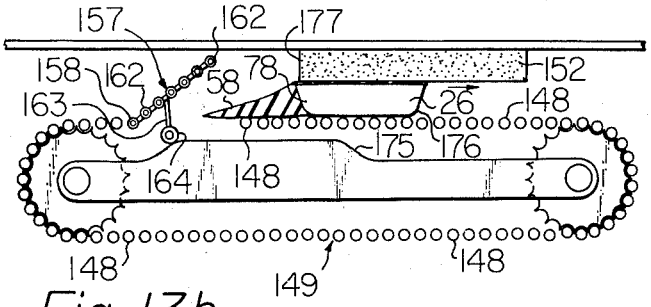
FIGS. 13*a* to 13*d* are fragmentary side views showing the sequence of operation of the apparatus for securing the trailing ear portion to the bottom side of the cylindrically shaped strip section shown in FIG. 8.
Figure 13B:
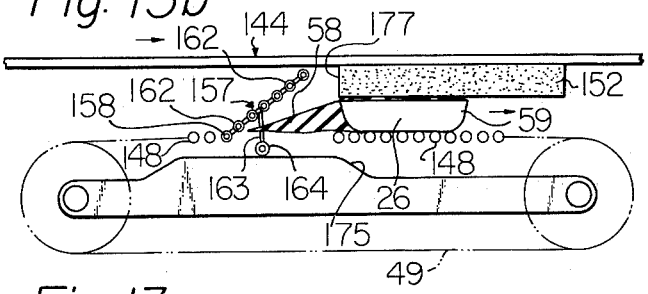
Figure 13C:
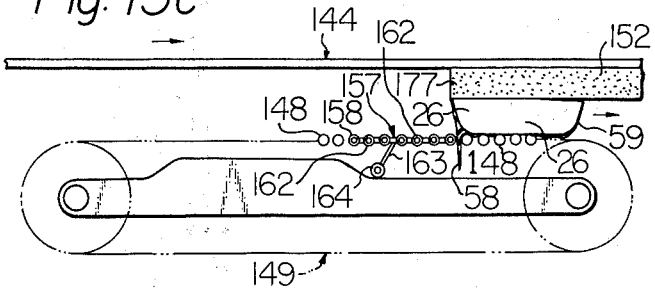

In operation, when the cylindrically shaped strip section wrapping therein the goods and the tray 26 is advanced by the sponge-like member 152 of the belt 144 on the upper stretch of the roller conveyor 149 with the trailing ear portion 58 extending rearwardly, the capturing device 157 runs after the trailing ear portion 58 with the capturing device held in the state that the same is swung upwardly by the engagement of the roller 164 with the raised portion of the cam 175 (FIG. 13) and catches up with the trailing ear portion 58 (FIG. 13*b*). When the capturing device 157 has captured the trailing ear portion 58 during the feeding of the cylindrically shaped strip section, the roller 164 of the capturing device 157 is disengaged from the raised portion of the cam 175 so that the capturing device 157 is swung downwardly by the action of the springs 167, 168 and held in alignment with the stretch of the roller conveyor 149 by the stopper plates 171, 172 thereby capturing the trailing ear portion 58 between the roller 162 of the capturing device 157 and the roller 148 of the roller conveyor 149 (FIG. 13*c*).

Figure 13D:
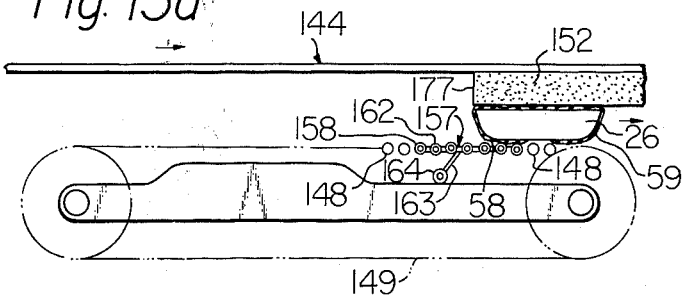

Since the roller conveyor 149 is moved faster than the cylindrically shaped strip section which is fed by the belt 144, the trailing ear portion 58 is folded back upon the bottom side of the cylindrically shaped strip section so as to be adhered thereto (FIG. 13*d*). Thus, the complete pack is formed and discharged from the apparatus.

Figure 14:
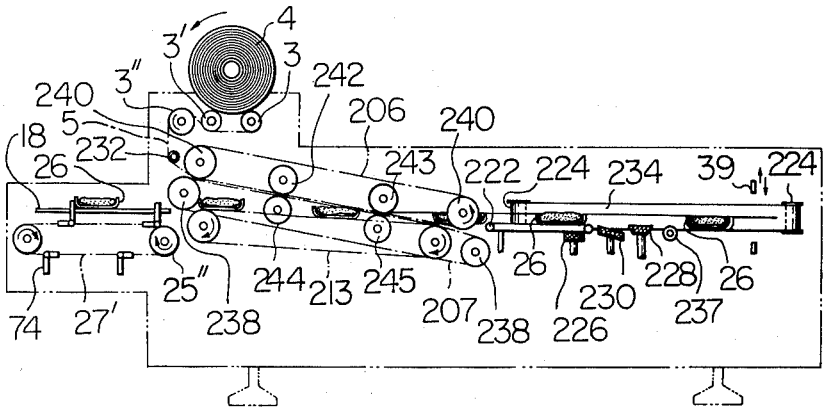
FIG. 14 is a general side view schematically showing the alternative embodiment of the present invention shown in FIG. 1.
Figure 15:
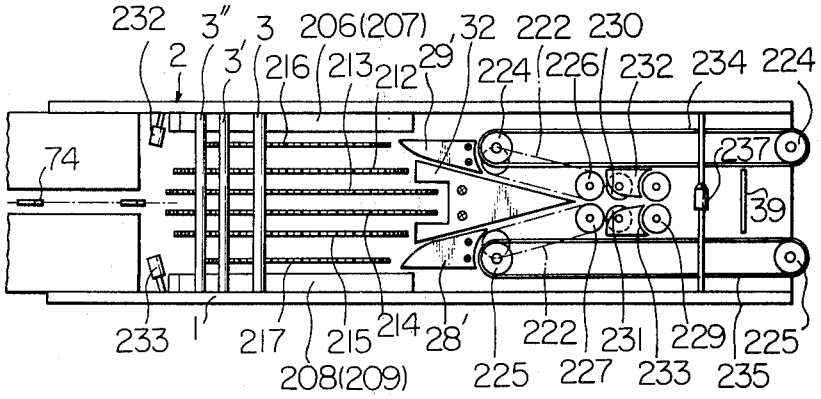
FIG. 15 is a plan view of FIG. 14.
Figure 16:
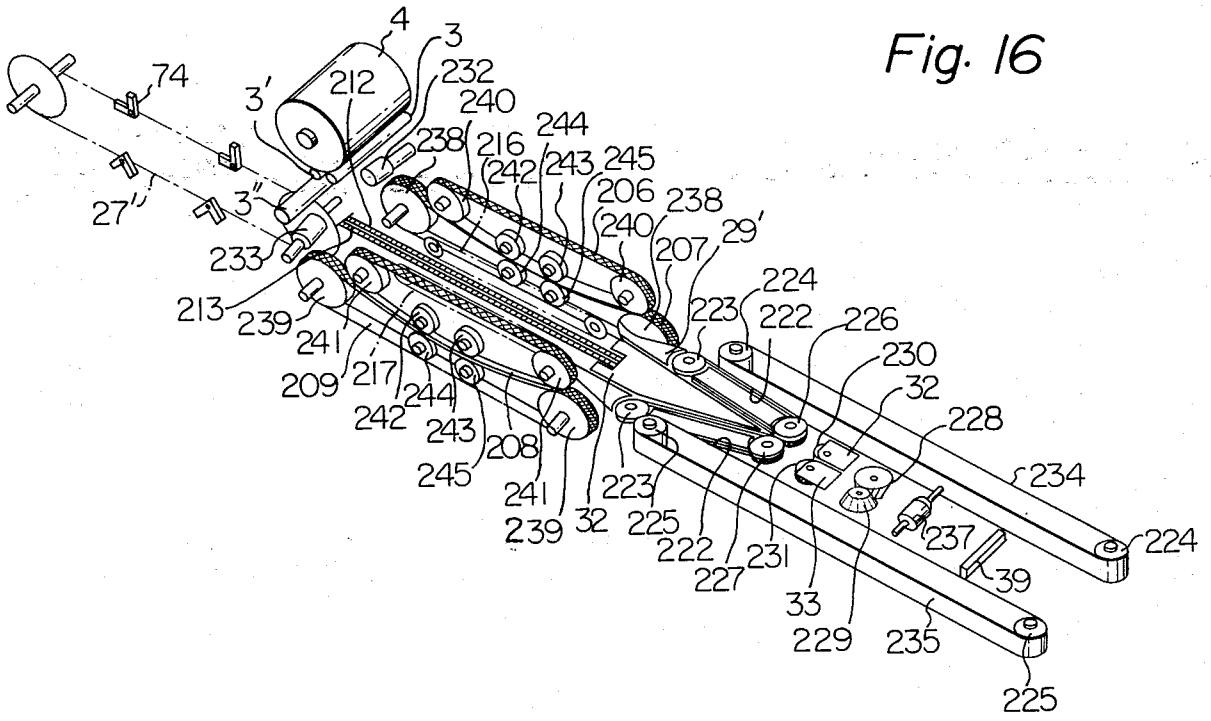
FIG. 16 is a general perspective view of FIG. 14.

FIGS. 14 to 16 show a modification of the apparatus shown in FIG. 1 for automatically forming cylindrically shaped continuous strip wrapping therein goods at positions a predetermined distance spaced from each other by continuously feeding the goods as well as the strip for wrapping the goods.

The apparatus shown in FIG. 14 is substantially similar to that shown in FIG. 1 except that double link chains 10, 11, 14 15 of FIG. 1 are replaced by two pairs of endless belts 206, 208, 207, 209 stretched around 240, 240, 241, 241, 238, 238, 239, 239 and urged toward each other by tension pulleys 242, 243, 244, 245, respectively and the sponge-like belt 40 of FIG. 1 is replaced by a pair of side belt conveyors 234, 235 stretched around pulleys 224, 225 and urging the cylindrically shaped strip section from the opposite lateral sides for feeding the same thereby clearing the upper side of the cylindrically shaped strip portion. Thus, the upper side of the cylindrically shaped strip section is maintained unobstructed by the conveyor thereby incurring superior appearance while the removal of the goods in case of jamming is facilitated without the need of disassembling the conveyor.

In the embodiment shown in FIGS. 14 to 16, a plurality of parallel chain conveyors 212, 213, 214 and 215 are provided for feeding the goods with tray 26 successively after discharged from the conveyor 27' which is similar to conveyor 27 in FIG. 1 as shown in FIG. 15.

In accordance with the feature of the present invention, a pair of guide rollers 232, 233 (FIG. 15) are mounted on the frames 2 and 1, respectively. The axes of these rollers are adjustably directed upwardly inwardly toward the upstream of the feeding of the goods so that the strip 5, after guided by the rollers 232, 233, is bent in tunnel-like shape or inverted U-shape in transverse cross-section of the strip 1. Further, a pair of chain conveyors 216, 217 are arranged adjacent to the opposite longitudinal side edge portions of the strip 5 clamped and fed by the belts 206, 207, 208, 209 as shown in FIG. 15. The level of the upper stretch each of the chains 216, 217 is held higher than the level of the upper stretch each of the conveyors 212, 213, 214, 215 so that the strip 5 is guided by the chains 216, 217 so as to maintain the inverted U-shape of the transverse cross-section of the strip 5 until the strip 5 contacts the upper side of the goods placed on the tray 26. This serves to prevent the strip 5 from contacting the tray 26 until the upper side and the upper portion of the lateral sides of the goods are completely wrapped by the strip 5. Thus, the upper side of the complete pack is prevented from being creased, because the tray 26 is prevented from contacting with the strip 5 so as to be deformed to expand during the wrapping of the upper side of the goods which will cause the resilient contacting deformation of the tray 26 after completion of the wrapping operation resulting in creasing of the upper side of the complete pack.

In the embodiment shown in FIGS. 14 to 16, a pair of endless guide belts 222, 222 replace the guide plates 28, 29 of FIG. 3, but the operation thereof is similar to that of the guide plates 28, 29. The pulleys 226, 227 around which the belts 222, 222 are stretched are formed with knurled portions as shown in FIG. 16 which serve as pressing rollers similar to pressing rollers 33, 34 of FIG. 3. Rollers 230, 231 assist the firm adhesion of the joined longitudinal side edge portions of the strip 5.

Further, a pair of rollers 228, 229 are provided for urging the joined longitudinal side edge portions of the strip 5 toward the bottom side of the cylindrically shaped strip section in place of guide slot 36 of FIG. 3. To this end, the roller 229 has a frustrum-shaped knurled peripheral surface tapering upwardly as shown in FIG. 16 which cooperates with the complementarily shaped frustrum peripheral surface of the roller 228.

Roller 237 rotatable about the horizontal axis serves to urge the joined longitudinal side edge portions against the bottom side of the cylindrically shaped strip section so as to be adhered thereto.

FIGS. 17 to 22 show a further embodiment of the apparatus in accordance with the present invention for securing the leading and trailing ear portions 59, 58 to the bottom side of the cylindrically shaped strip section within which the goods is wrapped.

The apparatus shown in FIG. 17 to 22 is adapted to be connected to the apparatus shown in FIGS. 14 to 16 downstream thereof by increasing the length of the belt conveyors 234, 235 downstream of the feeding of the cylindrically shaped strip wrapping therein goods at positions spaced a predetermined distance from each other. The cylindrically shaped strip is formed by the apparatus shown in FIGS. 14 to 16. However, the cylindrically shaped strip may be formed by any other suitable apparatus.

Figure 17:
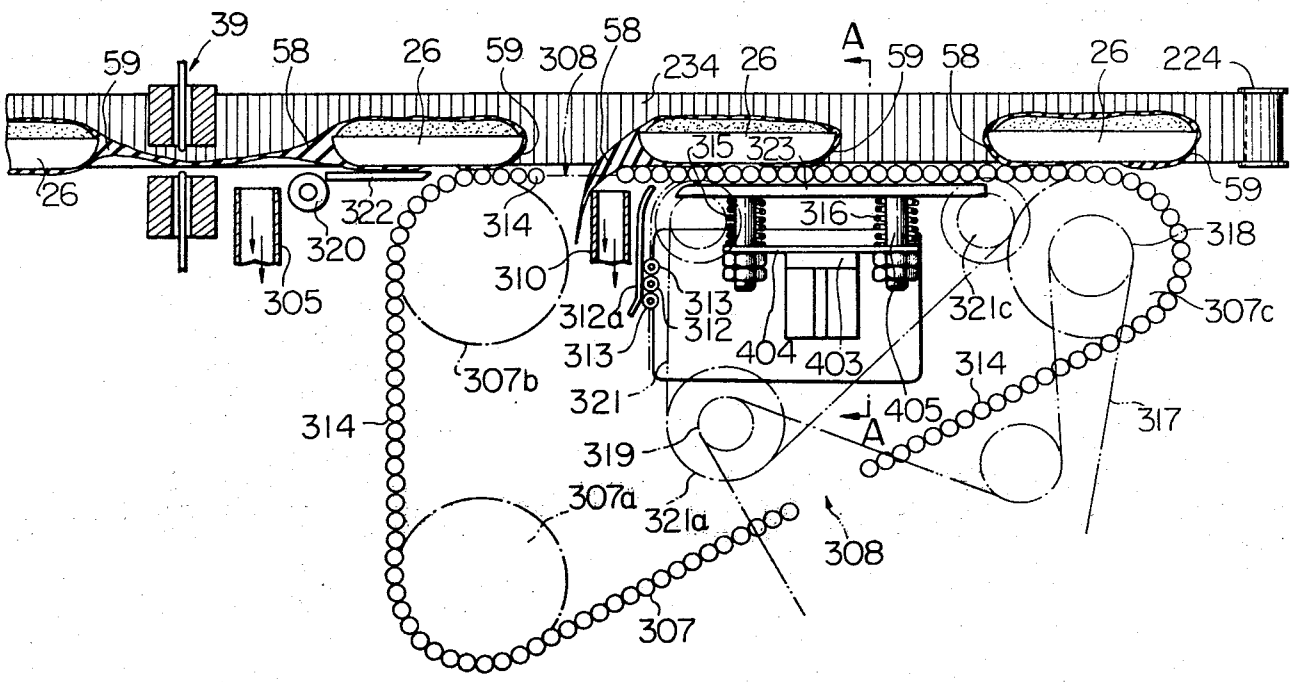
FIG. 17 is a fragmentary longitudinal sectional view showing a further embodiment of the apparatus for securing the leading and trailing ear portion to the bottom side of the cylindrically shaped strip section in accordance with the present invention.
Figure 18:
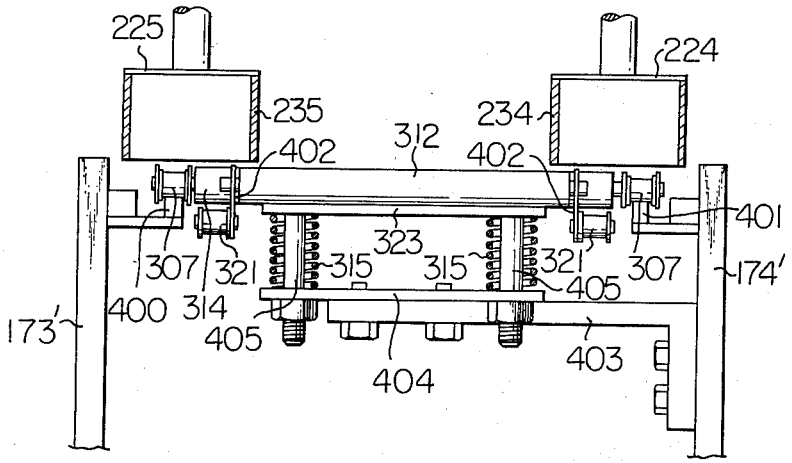
FIG. 18 is a cross-sectional view of FIG. 17 along line A—A.
Figure 19:
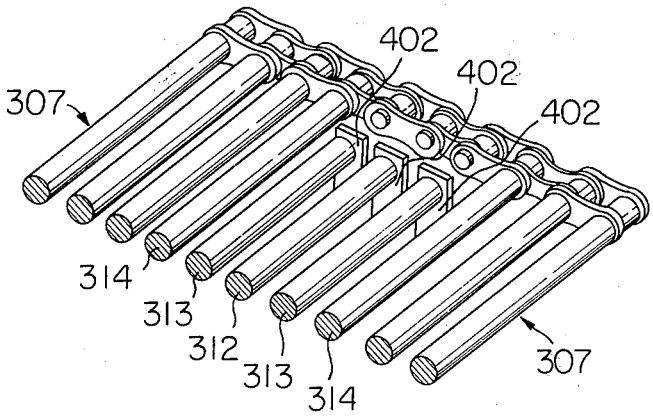
FIG. 19 is a fragmentary perspective view showing the arrangement of the endless conveyor supporting the cylindrically shaped strip section and the roller train moved in the discontinued clearance in the endless conveyor alignment therewith.
Figure 20:
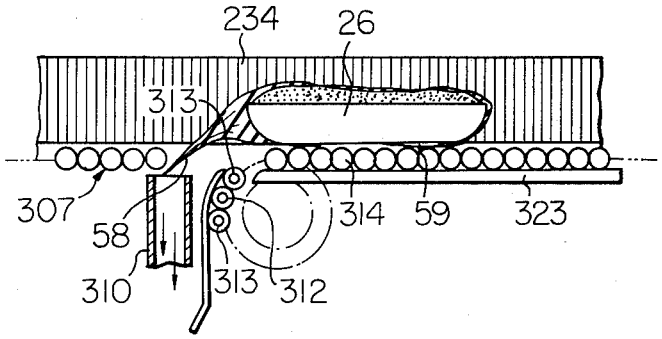
FIGS. 20 to 22 are fragmentary side views showing the sequence of operation of the apparatus for securing the trailing ear portion to the bottom side of the cylindrically shaped strip section shown in FIG. 17.
Figure 21:
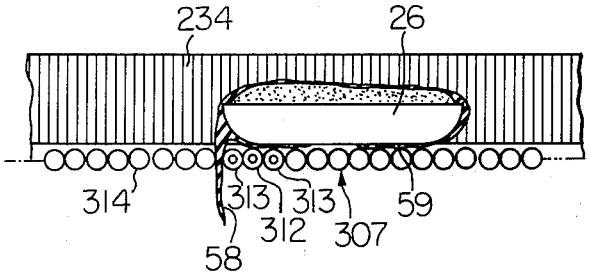
Figure 22:
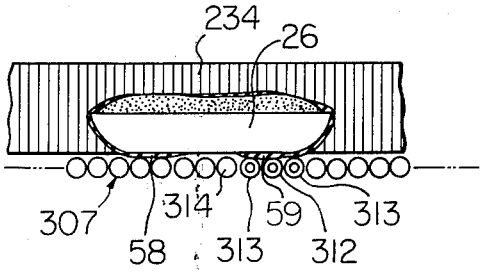

In FIG. 17, cutting device 39 is arranged between the side belt conveyors 234, 235 and a vacuum sucking member 305 is located under the belt conveyors 234, 235 adjacent to the cutting device 39 downstream of the feeding of the cylindrically shaped strip.

Further, a guide roll 320 and a guide plate 322 are arranged downstream of the vacuum sucking member 305 beneath the side belt conveyors 234, 235 as shown in FIG. 17.

The cylindrically shaped strip is severed by the cutting device 39 as the same is advanced by the side belt conveyors 234, 235 so as to form a trailing ear portion 58 of the preceding cylindrically shaped strip section and a leading ear portion 59 of the succeeding cylindrically shaped strip.

As the succeeding cylindrically shaped strip with the leading ear portion 59 extending forwardly is fed by the conveyors 234, 235, the vacuum sucking member 305 is operated so as to capture the leading edge 59. Since the cylindrically shaped strip is further advanced by the belt conveyors 234, 235 while the leading ear portion 59 is captured by the sucking member 305, the leading ear portion 59 is guided by the guide roller 320 and the guide plate 322 so as to be folded back upon the bottom side of the cylindrically shaped strip thereby adhering thereto, the vacuum sucking member 305 being rendered inoperable after the leading ear portion 59 is guided by the guide roller 320.

At that time, the trailing portion of the cylindrically shaped strip within which the goods is wrapped comes to the position at which it is to be severed by the cutting device 39, and the trailing portion is severed so as to form the trailing ear portion 58 of the preceding cylindrically shaped strip section and the leading ear portion 59 of the succeeding cylindrically shaped strip, and the above procedures are repeated.

Now the apparatus for securing the trailing ear portion 58 to the bottom side of the cylindrically shaped strip section will be described with reference to FIGS. 17 to 22.

An endless roller conveyor comprised of a plurality of rotatable rollers 314 and having at least one discontinued clearance 308 is driven by a pair of link chains 307 located at opposite longitudinal side edges (FIG. 18) which are stretched around sprockets 307*a*, 307*b* and 307*c*, the sprocket 307*c* being driven through a chain 317 stretched around the sprocket 318 integral with the sprocket 307*c* by a driving means (not shown). The upper stretch of the endless roller conveyor comprised of the rollers 314 is guided by guide rails 400, 401 secured to the side plates 173′, 174′ which are mounted in the frames 1, 2 so that the upper stretch allows the cylindrically shaped strip section supported thereon to be freely slid relative thereto.

The roller conveyor comprised of the rollers 314 is driven at a speed higher than that of the side belt conveyors 234, 235 in like manners as described previously.

A vacuum sucking member 310 is located downstream of the sprocket 307*b* beneath the side belt conveyors 234, 235.

A pressing plate 323 is vertically slidably mounted by rods 405 on a supporting plate 404 secured by a bracket 403 to the side plate 174′ and urged upwardly by springs 315 (FIG. 18) so that the pressing plate 323 resiliently supports the upper stretch of the roller conveyor comprised of rollers 314 (FIG. 17).

A roller train comprised of rotatable rollers 313, 312 and 313 are supported by upstanding plates 402 (FIG. 18) which are mounted on link chains 321 guided by sprockets 321*a*, 321*b* and 321*c* and driven by the chain 317 stretched around a sprocket 319 integral with the sprocket 321*a* (FIG. 17).

The roller train comprised of rollers 313, 312, 313 is guided by a guide plate 312*a* during the operation thereof so that the roller train is introduced into the clearance 308 of the endless roller conveyor comprised of the rollers 314 when the same is moving in the upper stretch of the roller conveyor. Thus, the roller train is moved together with the upper stretch of the conveyor in alignment therewith along the pressing plate 323.

The operation of the roller conveyor, the vacuum sucking member 317 and the roller train is so timingly related to the feeding of the cylindrically shaped strip section fed by the side belt conveyors 234, 235 that when the trailing ear portion 58 is moved to the position above the sucking member 310, the clearance 308 of the roller conveyor is moved to align with the sucking member 310 while the roller train is moved adjacent to the upper stretch of the roller conveyor. At this time, the vacuum sucking member 310 is operated to capture the trailing ear portion 58 into the clearance 308 (FIG. 17). Then, the roller train is moved into the clearance 308 through the position shown in FIG. 20, so that the trailing ear portion 58 is slidably clamped between the rollers 313 and 314 (FIG. 21) as the cylindrically shaped strip section is advanced by the side belt conveyors 234, 235.

Since the roller conveyor comprised of the rollers 314 is moved faster than the cylindrically shaped strip section fed by the side belt conveyors 234, 235, the trailing ear portion 58 clamped between the rollers 314 and 313 is folded back upon the bottom side of the cylindrically shaped strip section so as to be adhered thereto (FIG. 22) and the complete pack thus formed is discharged from the apparatus by the action of the side belt conveyors 234, 235.

I claim:

1. Method of automatically wrapping discrete quantities of goods fed continuously in a fixed generally horizontal first path and spaced a predetermined distance from each other along said path to form separate packs, by means of a continuously fed strip of stretch film having self-adhering and resiliently stretchable natures, wherein the improvement comprises the steps of feeding said strip by conveyor means in a fixed second path from above said first path obliquely downwardly so as to intersect said first path while maintaining said strip tensioned laterally of said second path, thereby successively wrapping the respective quantities of goods from the upper side thereof, over and about both lateral sides thereof, subsequently continuously guiding the opposite longitudinal side edge portions of said strip toward and around the bottom side of the goods into overlapping relation so as to form a cylindrical tubular shaped enclosure of said goods, pressing together the overlapping longitudinal side edge portions of said strip to secure said overlapping edges together at and along the bottom side of said enclosure thus wrapping therein said quantities of goods, and sequentially severing said enclosure transversely thereof intermediate said quantities to thus form discrete packs each having a leading and a trailing ear portion of said enclosure, and sequentially folding said leading and trailing ear portions beneath and upon the bottom side of each respective pack for sealing thereto.

2. Method according to claim 1, further comprising the steps of bending said strip laterally of said second path by roller means to thereby form the strip into an inverted U-shape in transverse section before said strip contacts the quantities of goods moving along said first path, and longitudinally supporting said strip adjacent to both longitudinal side edge portions thereof by a pair of conveyor means so as to maintain said inverted U-shape thereby preventing said strip from contacting lateral sides of the goods until the upper side of the goods has been contacted by said strip thus preventing deformation of said goods after completion of the wrapping thereof.

3. The method of claim 1, said strip being held laterally tensioned as aforesaid, by first and second pairs of chains each pair having contiguous runs parallel with said second path and gripping therebetween a respective side edge of said strip as it moves obliquely downwardly, and driving said chains at a speed equal to that of said quantities of goods in and along said first path.

* * * * *